US010569912B2

(12) United States Patent
Heinrich et al.

(10) Patent No.: US 10,569,912 B2
(45) Date of Patent: Feb. 25, 2020

(54) TAMPING PUNCH STATION AND METHOD OF FILLING CAPSULES IN A TAMPING PUNCH STATION

(71) Applicant: Fette Engineering GmbH, Schwarzenbek (DE)

(72) Inventors: Thomas Heinrich, Stelle (DE); Daniel Malick, Ahrensburg (DE); Jan Fabian Scheffler, Hamburg (DE); Jan-Eric Kruse, Meerbusch (DE); Afsaneh Nakhavoli, Hamburg (DE)

(73) Assignee: Fette Engineering GmbH, Schwarzenbek (DE)

( * ) Notice: Subject to any disclaimer, the term of this patent is extended or adjusted under 35 U.S.C. 154(b) by 736 days.

(21) Appl. No.: 14/577,278

(22) Filed: Dec. 19, 2014

(65) Prior Publication Data

US 2015/0175279 A1 Jun. 25, 2015

(30) Foreign Application Priority Data

Dec. 20, 2013 (DE) ..... 10 2013 114 693

(51) Int. Cl.
*B65B 1/04* (2006.01)
*B65B 63/02* (2006.01)
(Continued)

(52) U.S. Cl.
CPC ..... *B65B 1/04* (2013.01); *A61J 3/074* (2013.01); *B30B 1/18* (2013.01); *B30B 9/3064* (2013.01); *B65B 63/026* (2013.01)

(58) Field of Classification Search
CPC .... A61J 3/07; A61J 3/074; B65B 1/04; B65B 1/06; B65B 1/10; B65B 1/12; B65B 1/20;
(Continued)

(56) References Cited

U.S. PATENT DOCUMENTS 3,213,587 A * 10/1965 Carruthers ..... B65B 1/363 53/435
3,921,681 A * 11/1975 Rebmann ..... A61J 3/074 141/258
(Continued)

FOREIGN PATENT DOCUMENTS

DE 196 18 237 C1 8/1997
DE 196 51 237 A1 6/1998
(Continued)

OTHER PUBLICATIONS

English Translation of DE 10-2012-010-767, from Espacenet, Sep. 8, 2017, 8 pages.*
U.S. Appl. No. 14/559,905, filed Dec. 3, 2014.

*Primary Examiner* — Gloria R Weeks
(74) *Attorney, Agent, or Firm* — Young Basile Hanlon & MacFarlane, P.C.

(57) ABSTRACT

A tamping punch station for filling capsules in a capsule filling machine is described. The machine includes a rotatably drivable dosing disk with bore holes and a filling device for filling the bore holes. Tamping punches and ejection punches are held on a punch support, and vertical movement of the punch support causes the tamping punches to press filling material into the bore holes and the ejection punches to eject pellets created by the tamping punches in the bore holes. A first drive rotates the dosing disk along punches and a second drive moves the punch support. The second drive includes at least two spindle drives acting on the punch support with respectively one spindle nut and respectively one vertical drive spindle guided in the spindle nut and at least two drive motors, which drive respectively one of the spindle drives for vertical movement of the punch support.

18 Claims, 3 Drawing Sheets

(51) Int. Cl.
*B30B 1/18* (2006.01)
*A61J 3/07* (2006.01)
*B30B 9/30* (2006.01)

(58) Field of Classification Search
CPC .. B65B 1/24; B65B 1/30; B65B 1/363; B65B 1/38; B65B 63/02; B65B 63/026; B30B 1/18; B30B 1/181; B30B 9/28; B30B 9/306; B30B 9/3064; B30B 11/00; B30B 11/02; B30B 11/08; B65G 47/34; B65G 47/52; B65G 47/82; B65G 47/96
USPC ..... 53/122, 235, 258, 281, 282, 438, 454, 53/468, 473, 527; 198/370.01–370.03, 198/370.07; 141/12, 71; 425/345
See application file for complete search history.

(56) References Cited

U.S. PATENT DOCUMENTS 4,062,386 A * 12/1977 Zanasi ..... A61J 3/074 141/258
4,084,497 A * 4/1978 Khan ..... B30B 9/3032 100/229 A
4,121,400 A * 10/1978 Sohn ..... B65B 1/24 53/239
4,501,307 A * 2/1985 Moser ..... A61J 3/074 141/12
4,884,602 A * 12/1989 Yamamoto ..... A61J 3/074 141/235
5,078,304 A * 1/1992 Schneider ..... B65B 43/54 100/104
5,287,897 A * 2/1994 Gamberini ..... A61J 3/074 141/130
5,454,206 A * 10/1995 Bailer ..... B65B 59/00 53/157
5,626,171 A * 5/1997 Mirri ..... A61J 3/074 141/145
5,906,837 A * 5/1999 Link ..... B22F 5/08 425/150
6,098,675 A * 8/2000 Runft ..... B65B 1/363 141/71
6,390,330 B2 * 5/2002 Runft ..... A61J 3/074 141/146
6,425,422 B1 * 7/2002 Trebbi ..... A61J 3/074 141/12
6,527,537 B2 * 3/2003 Arndt ..... B30B 11/085 425/134
6,585,013 B2 * 7/2003 Gamberini ..... A61J 3/074 141/144
6,792,788 B2 * 9/2004 Futamura ..... B30B 1/186 100/270
6,810,930 B2 * 11/2004 Schlipf ..... A61J 3/074 141/130
6,948,925 B2 * 9/2005 Fischbach ..... B29C 45/661 425/451.6
7,541,707 B2 * 6/2009 Hochhalter ..... B23K 11/31 310/80
7,641,466 B2 * 1/2010 Malick ..... B30B 11/08 425/345
7,677,016 B2 * 3/2010 Trebbi ..... A61J 3/074 53/253
8,151,830 B2 * 4/2012 Schmied ..... A61J 3/074 141/71
8,453,687 B2 * 6/2013 Schmied ..... A61J 3/074 141/144
8,621,825 B2 * 1/2014 Schmied ..... A61J 3/074 53/244
8,668,483 B2 * 3/2014 Mercado ..... B30B 1/18 425/138
8,950,445 B2 * 2/2015 Schlipf ..... A61J 3/074 141/146
9,272,479 B2 * 3/2016 Behns ..... B30B 1/181
9,289,924 B2 * 3/2016 Behns ..... B30B 1/181
2009/0232922 A1 * 9/2009 Schlipf ..... A61J 3/074 425/150
2011/0146841 A1 * 6/2011 Ansaloni ..... A61J 3/074 141/168
2013/0180301 A1 * 7/2013 Schoellhammer ..... B21D 24/00 72/20.1
2013/0205715 A1 * 8/2013 Barbolini ..... B67B 3/2033 53/317
2015/0217486 A1 * 8/2015 Pannewitz ..... B30B 1/18 425/352
2016/0152356 A1 * 6/2016 Rubbi ..... B65B 29/02 53/473

FOREIGN PATENT DOCUMENTS

DE 102 11 118 A1 9/2003
DE 10 2006 014 496 A1 4/2007
DE 10 2010 040 505 A1 4/2011
DE 102011116552 A1 * 4/2013 ..... B30B 1/181
DE 10 2012 010 767 A1 12/2013
EP 2 311 587 A1 4/2011
KR 10-0704098 B1 4/2007
WO 00/32474 A1 6/2000
WO 2013/178355 A1 12/2013

* cited by examiner

TAMPING PUNCH STATION AND METHOD OF FILLING CAPSULES IN A TAMPING PUNCH STATION

CROSS-REFERENCE TO RELATED APPLICATION

This application claims priority to German Patent Application No. 10 2013 114 693.7, filed Dec. 20, 2013, the content of which is incorporated herein in its entirety by reference.

FIELD OF THE DISCLOSURE

The disclosure relates to a tamping punch station for filling capsules with filling material in a capsule filling machine and to a method for filling capsules with filling material in a tamping punch station of a capsule filling machine.

BACKGROUND

Tamping punch stations are used in capsule filling machines, which may be designed as so-called rotary machines. They have different process stations distributed around the perimeter, in particular a feeding station and separating station for separating the capsule halves, one or more dosing stations, a closing station for closing the capsule halves, one or more ejection stations and, if applicable, one or more emptying stations. Tamping punch stations for example are used as dosing stations, which are suitable for dosing filling material and transferring it to capsules.

The diameter and distance between the bore holes of tamping punch stations are adjusted for the capsules to be filled that are held in a capsule holder of the capsule filling machine. The tamping punch station includes for example five groups of tamping punches and one group of ejection punches. At the groups of tamping punches, pellets are gradually created in the bore holes from the filling material. The group of ejection punches pushes the pellets out of the bore holes and transfers the pellets thusly into the bottom parts of the capsules held in the capsule holders.

A dosing disk is often driven incrementally via a step switching gearbox so that the individual groups of bore holes approach successively the groups of tamping punches and the group of ejection punches. Each cycle is divided into a rest time and a switch time. The rest time is the standstill time, in which the dosing disk sits and the pellets are formed or respectively ejected. The switch time is the movement time of the dosing disk, in which the dosing disk rotates around its axis and each group of bore holes cycles further to the next group of punches. The ratio between switch and rest time is determined during the course of the design of the step switching gearbox and cannot be changed after that.

Moreover, tamping punch stations have a lifting device, which carries the tamping punches and the ejection punches and moves, e.g. up and down vertically, according to the clocked movement of the dosing disk. The lifting device is generally driven by a mechanical cam, wherein the stroke length is determined one time during the design of the tamping punch station and is also no longer adjustable. The pellets are built in stages through different fastening heights of the groups of tamping punches on the lifting device. In order to ensure that the rotation of the dosing disk and the movement of the lifting device are synchronized, both drive trains are mechanically coupled and driven by a common drive. While the dosing disk is in its switch time and rotates for example at six groups of bore holes by 60°, the tamping punches already begin their vertical downwards movement. They reach the bore holes of the dosing disk and, if applicable, a powder bed made of filling material only when the dosing disk has already reached its position for the rest time. After the pressing procedure, the punches move back into their initial position, wherein the dosing disk already begins to turn further before the punches have reached their uppermost position.

A further tamping punch station is known from DE 10 2006 014 496 A1. The punches are thereby held on a support, which is driven via columns. The columns are connected with a common servodrive via a crank drive so that the columns should run synchronously.

BRIEF SUMMARY

Due to the use of step switching gears for the dosing disk in the initially-described tamping punch stations, the ratio between the rest and switch times is rigid. If the rest time needs to be extended for production reasons, for example due to the necessity of a longer fill time as a result of poorly flowing filling material, the switch time is also extended. Correspondingly, if the switch time needs to be extended, for example since otherwise an even bed of filling material is not formed on the dosing disk, the rest time is also extended. The entire cycle time from the stopping and turning of the dosing disk is thereby extended more than necessary.

Moreover, the movement sequences of the dosing disk and the punches are dependent on each other due to the coupling of the drive trains for the rotation of the dosing disk and the lifting movement of the punches. If one of these movements needs to be slowed, the other movement is also automatically slowed. For example, it may be required that the tamping punches dip slower into the powder bed and the bore holes. A fixed lift of the tamping punches is provided by the also provided mechanical cams. Only through a change in the fastening height of the tamping punches or respectively of the pressing force can the pellet height and thus the density and mass of the produced pellets be influenced. This can be realized through a separately adjustable fastening height of the tamping punches or respectively through adjustable spring characteristics (pneumatic or mechanical). However, individual drives are partially provided to accomplish these adjustments, which is a disadvantageous and structurally complex solution.

Similarly, in DE 10 2006 014 496 A1 there is considerable construction effort required for the drive of the columns. This is disadvantageous as it is difficult to make adjustments to the drive. Moreover, all pressing forces must be transferred from a single servodrive.

In contrast, a tamping punch station and a method described herein result in high-quality pellets that can be produced in a structurally simple manner. The methods described herein should achieve high flexibility even for trial pressings in the field of galenics.

A tamping punch station for filling capsules with filling material described herein may be incorporated in a capsule filling machine and include a rotatably drivable dosing disk with at least one group of bore holes, a filling device for filling the bore holes with the filling material and at least one group of tamping punches and one group of ejection punches. The tamping punches and the ejection punches are held on a vertically moveable punch support so that, through vertical movement of the punch support, the tamping punches for pressing the filling material into the bore holes and the ejection punches for ejecting pellets created by the tamping punches in the bore holes can be moved into the bore holes.

For such a tamping punch station first drive means are provided for the incremental rotation of the dosing disk along the at least one group of tamping punches and the group of ejection punches and second drive means are provided for the vertical movement of the punch support. The second drive means comprises at least two spindle drives acting on the punch supports with respectively one spindle nut and respectively one vertical drive spindle guided in the spindle nut. The second drive means also comprises at least two drive motors, each of which drives one of the spindle drives for vertically moving the punch support.

The rotatably driven dosing disk can have several groups of bore holes, which are guided successively along the groups of tamping punches and ejection punches by turning the dosing disk. Several groups of tamping punches can also be provided, which are run through successively by the bore holes. For example, five groups of tamping punches can be provided and one group of ejection punches. In this example, six groups of bore holes can be arranged distributed along the perimeter of the dosing disk. With respect to their diameter and arrangement in relation to each other, in particular their distance from each other, the bore holes are adjusted for the capsules to be filled in a capsule filling machine equipped with the tamping punch station and located in a capsule holder.

The tamping punches each move into the correspondingly aligned bore holes through vertical movement and press e.g. powdered filling material located in the bore holes into pellets. The bore holes are predominantly filled with the filling material by gravity. Moreover, the tamping punches can convey filling material into the bore holes in the course of their downwards movement, which lies for example on the dosing disk. The tamping punches compress this filling material in the bore holes. In particular, when several groups of tamping punches are provided, which are approached successively by the bore holes, the pellets are created incrementally. The groups of tamping punches can be arranged for this at different heights on the support or the tamping punches of different groups can have a different length. The diameter of the bore holes and the height of the dosing disk give the size of the produced pellets and thus the quantity of filling material to be dosed.

The pellets are ejected from the bore holes by the ejection punches and transferred to the capsule bottom parts normally arranged for this with their capsule holder below the bore holes. The bore holes are closed on their bottom side when the tamping punches are moved into the bore holes and open on their bottom side when the ejection punches are moved into the bore holes. The closure of the bore holes in the area of the tamping punches can take place, for example, through a tamping disk. The tamping disk may form a counter bearing for the tamping punches for pressing the filling material into pellets. The dosing disk is rotated incrementally during the course of the production and transfer of the pellets, wherein it goes in turn through standstill times (rest times) and movement times (switch times).

In the case of the tamping punch station according to embodiments of the invention, separate drive means are provided for incremental rotation of the dosing disk on one hand and for the vertical movement of the punch support on the other hand. The second drive means moving the punch support vertically has at least two spindle drives with vertical drive spindles, which are guided with an external thread designed at least via a section of its length in an internal thread of a spindle nut. Moreover, the second driving means has at least two drive motors, one of which respectively drives one of the spindle drives, in particular the spindle nuts or the drive spindles in a rotatable manner. The drive spindles or the spindle nuts are thereby moved in the vertical direction and thus move the punch support and with it the tamping punches and ejection punches up and down in the vertical direction.

The drive trains for the dosing disk on one hand and the tamping punches or respectively ejection punches on the other hand are thus separated. Moreover, it is possible to variably adjust the ratio between standstill times and movement times of the dosing disk, i.e. the rest time and the switch time, through selection of a suitable drive for the first drive means. A suitable control device can be provided for this. It is also hereby possible to variably adjust the rotational speed of the dosing disk, the rotational path as well as the direction of rotation. Moreover, the vertical travel and the vertical travel speed of the punch support and thus of the tamping and ejection punches can be variably adjusted based on the separate second drive means for the punch support. This can also take place through the control device. The spindle drives provided according to the invention are characterized by low constructive effort and are controllable precisely and synchronously. The provision of two spindle drives for the punch support is thus not a problem in terms of synchronization. Moreover, such spindle drives transfer very high pressing forces.

As already mentioned, it is possible through a variable adjustment of the stroke length of the tamping punches to change the pressing force of the tamping punches without needing to provide separate adjustment options, for example separate drives. All groups of tamping punches are thereby set in the same manner, which leads to continuously homogeneous pellets. Variable pressing force progressions can also be adjusted through the separately designed second drive means. While in existing tamping punches the dipping speed and the duration of the maximum pressing force is adjusted in a mechanically unchangeable manner via a corresponding cam, different pressing force progressions can be realized through the control device. This can be used for example for a suitable extension of the pressure hold time without influencing the switch time of the dosing disk in an undesired manner. A larger processing window results for different products.

Accordingly, the teachings herein also relate to a method for filling capsules with filling material in a tamping punch station of a capsule filling machine, wherein the tamping punch station comprises a rotatably drivable dosing disk with at least one group of bore holes, a filling device for filling bore holes with the filling material, at least one group of tamping punches and one group of ejection punches, wherein the tamping punches and the ejection punches are vertically moveable, and wherein the tamping punch station has first drive means for incremental rotation of the dosing disk along the at least one group of tamping punches and the group of ejection punches and second drive means for the vertical movement of the at least one group of tamping punches. The method includes rotating the dosing disk into a rotational position in which the group of bore holes is aligned with a group of tamping punches using the first drive means, moving the tamping punches into the bore holes for pressing filling material filled into the bore holes into pellets using the second drive means, wherein the tamping punches are held for a pressure hold time in the bore holes and then are retracted from the bore holes, rotating the dosing disk into a rotational position in which the group of bore holes is aligned with a group of ejection punches suing the first drive means, and moving the ejection punches into the bore holes for ejection of pellets created by the tamping punches in the bore holes. The pressure hold time of the tamping punches is varied between different filling processes through variable actuation of the first drive means and/or the second drive means.

The tamping punches, preferably the tamping punches and the ejection punches, can be held on a vertically moveable punch support, which is moved vertically by the second drive means. The pressure hold time of the tamping punches in the bore holes is defined as the time in which the maximum pressing force takes effect during a pressing process by the tamping punches. This pressure hold time can be adjusted in a targeted manner by a suitable controller of the first and/or second drive means. For example, the tamping punches can be moved into and out of the bore holes faster by the second drive means and thus the pressure hold time can be extended without changing the cycle times of the dosing disk. It is also possible to change the pressure hold time by changing the cycle times of the dosing disk in the case of a constant infeed and exit speed. In this manner, the pressure hold time can be changed in the case of a change in the filling process, for example a change of the filling material to be pressed, through the separate first and second drive means and thus individually adjusted for the respective process conditions. The quality of the pellets created in the tamping punch station can thereby be increased.

Through the separate first and second drive means, it is also possible to clear the tamping punch station in a simple manner after the end of production. For this, the lifting movement of the punch support can be deactivated and the dosing disk can be made, for example, to rotate so that powdered filling material still located in the tamping punch station can be discharged and collected. Moreover, it is possible that the tamping punch station has distance measurement and/or pressing force sensors, with which the path of the support or respectively of the tamping and/or ejection punches traveled in the course of the production of the pellets and/or the pressing forces occurring in the course of the production of the pellets are measured. The measurement results can be given to the control device and it can perform a suitable regulation of predetermined path lengths and/or pressing forces. Thus, certain pressing forces can be specified, for example, whereby in turn the mass and density of the produced pellets are defined.

According to a particularly practical design, the punch support can be a support plate or support bridge. In the case of the provision of two spindle drives, the spindle drives, in particular the drive spindles or the spindle nuts, are fastened on opposite-lying ends of the support plate or support bridge. A particularly consistent force generation is hereby achieved.

The spindle drives can respectively comprise a vertical drive spindle fastened on the punch support, wherein the drive spindles are respectively guided in a spindle nut mounted in a rotatable and axially fixed manner. The at least two drive motors can drive in a rotating manner, respectively, one of the spindle nuts for the vertical movement of the punch support. In this case, the drive spindles and with them the punch support thus move vertically by the rotation of the axially fixed spindle nuts.

According to an alternative design, the spindle drives can respectively comprise a rotatably and axially-fixed mounted vertical drive spindle, wherein the drive spindles are respectively guided in a rotatable manner in a spindle nut fastened on the punch support. The at least two drive motors drive in a rotating manner, respectively, one of the drive spindles for vertical movement of the punch support. In this case, the spindle nuts and with them the punch support thus move vertically by the rotation of the axially-fixed drive spindles.

The drive motors of the second drive means can be electric motors. The axially permanently-arranged spindle nuts or respectively drive spindles can then be fastened respectively on the rotors of the drive motors of the second drive means and turned with the rotors. These can be direct drives, in particular. Servomotors or torque motors may also be used as the electric motors as they can be controlled particularly well and flexibly.

According to a further embodiment, the axially permanently-arranged spindle nuts or respectively drive spindles can be arranged respectively in a blind hole of the drive motors. For example, if the spindle nuts are permanently-arranged axially in the blind hole, the drive spindles can be restricted in the axial direction by the end of the blind hole in this process so that an increased stroke length is available for the tamping and ejection punches. For further enlargement of the stroke length, the drive motors of the second drive means may be hollow shaft motors, wherein the axially permanently-arranged spindle nuts are arranged respectively in the hollow shafts of the drive motors. In particular, the rotors of the drive motors can be designed as hollow shaft rotors. In this design, a mainly unrestricted stroke length for the tamping and ejection punches is possible, in that in particular the drive spindles move axially in the hollow shaft.

The first drive means can comprise a servomotor. Furthermore, the first drive means can be a direct drive, for example a torque motor. A flexible movement of the dosing disk is particularly well-controlled through such drives.

The filling device can be formed by a filling trough at least partially covering the dosing disk, in which the filling material to be filled into the bore holes is located. The dosing disk rotates under this filling trough. The filling trough covers the dosing disk in particular such that the bore holes during their rotation, before reaching each group of tamping punches, pass through and under the filling trough and are still located in particular in the area of each group of tamping punches below the filling trough. The tamping punches then enter the bore holes through the filling material located in the filling trough, to thereby convey filling material not yet fallen into the bore holes into the bore holes through gravity and then press the filling material in the bore holes.

As already mentioned, the dosing disk can comprise at least two groups of bore holes. Furthermore, the dosing disk n can comprise groups of bore holes, wherein n is a natural number greater than 2. Then, n−1 groups of tamping punches are held on the punch support. For example, six groups of bore holes and correspondingly five groups of tamping punches and one group of ejection punches are provided.

The invention also relates to a capsule filling machine for filling capsules put together from a capsule top part and a capsule bottom part. According to an implementation of the teachings herein, the machine includes a conveyor wheel, on the perimeter of which a plurality of capsule holders is provided, each of which has a group of capsule receivers for respectively one capsule. The machine also includes a conveyor wheel drive, with which the conveyor wheel can be rotated incrementally so that the capsule holders move incrementally along a conveyor track, and a plurality of process stations arranged along the conveyor track, wherein the process stations comprise at least one feeding station for feeding capsules to be filled into the capsule receivers, at least one opening station for opening the capsules to be filled by separating the capsule top parts from the capsule bottom parts, at least one tamping punch station according to the teachings herein, at least one closing station for closing the filled capsules by connecting the capsule top parts with the capsule bottom parts, and at least one ejection station for ejecting the filled capsules. One or more process stations can thereby be integrated into one joint process station.

Another method described herein can includes steps where the dosing disk is rotated in a first rotational direction into a rotational position by means of a first drive means, in which the bore holes are aligned with the tamping punches, then, by means of second drive means, the tamping punches are moved vertically into and out of the bore holes for pressing filling material filled into the bore holes. Next, by means of the second drive means, the tamping punches are again moved vertically into and out of the bore holes for pressing filling material filled into the bore holes and, if required, this step is repeated one or multiple times. Thereafter, the dosing disk is rotated into a rotational position by means of the first drive means, in which the bore holes are aligned with the ejection punches, and the ejection punches are moved into the bore holes for ejection of pellets created by the tamping punches in the bore holes.

In this method and others according to this disclosure, a tamping punch station can be used that has exactly one group of tamping punches and exactly one group of ejection punches. Accordingly, there can be exactly one group of bore holes in the dosing disk. Based on the separation of the drive means for the dosing disk and the punch support, pellets can be built up incrementally through repeated movement of the group of tamping punches into and out of the bore holes incrementally, like in a tamping punch station with several groups of tamping punches. The stroke length of the tamping punches is thereby reduced by the second drive means, for example from one pressing procedure to the next. After, for example, five-time vertical movement of the group of tamping punches, the dosing disk can then be rotated such that the bore holes are aligned with the ejection punches and the pellets can be ejected by moving the ejection punch. In this manner, a particularly compact tamping punch station is enabled, which is well suited in particular as a laboratory machine in the field of galenics. The behaviour of the filling material in the course of the pressing by the tamping punch can also be particularly well examined on such a tamping punch station, i.e., in particular the question of how often and with which pressing force the tamping should take place.

In the course of the movement into the bore holes, the tamping punches respectively convey into the bore holes filling material that has not yet made its way into the bore holes through gravity so that the dosing disk between the individual pressing procedures does not have to be rotated. However, depending on the flow properties of the respective material, it can be necessary or desirable to turn the dosing disk between two pressing procedures (for example by 360°) so that the powder bed is closed again evenly. Accordingly, the dosing disk may be rotated in a first rotational direction and/or a second rotational direction after each pressing procedure and before the next pressing procedure by means of the first drive means until it again assumes the rotational position in which the bore holes are aligned with the tamping punches. The rotation of the dosing disk into the position of the bore holes aligned with the tamping punches or respectively ejection punches and the subsequent further rotation and the vertical movement of the tamping punches or respectively ejection punches can thereby take place offset in terms of time in relation to each other or at least partially in parallel, as generally described above.

In particular, if at least two groups of bore holes are provided in the dosing disk, the movement of the ejection punches into and out of the bore holes can take place by the second drive means, i.e., together with the tamping punches. However, as mentioned, a dosing disk with only one group of bore holes can also be used. In this case, the movement of the ejection punches into and out of the bore holes takes place through third drive means, by means of which the ejection punches are moveable independently of the tamping punches. In particular, if only one group of bore holes is provided, the provision of a separate drive means for the ejection punches is desired so that they do not move against the closed dosing disk together with the tamping punches during the creation of pellets in the bore holes by the tamping punches. It is therefore possible through the separate third drive means that the ejection punches in the case of a vertical entry of the tamping punches into the bore holes do not move with them. Moreover, in the case of the provision of third drive means for the ejection punches, the lift of the ejection punches is advantageously not impacted by the stroke of the tamping punches.

The methods described herein can be performed with a tamping punch station according to embodiments of the invention or respectively a capsule filling machine according to embodiments of the invention. It is possible that the tamping punches and the ejection punches are not arranged on a punch support in accordance with methods described herein. In the case of the use of the tamping punch station according to embodiments of the invention with only one group of bore holes, the third drive means for the separate movement can be arranged on the punch support so that the ejection punches are moveable separately from the tamping punches despite the common arrangement on the punch support.

Exemplary embodiments of the invention are explained in greater detail below based on the figures.

BRIEF DESCRIPTION OF THE DRAWINGS

The description herein makes reference to the accompanying drawings wherein like reference numerals refer to like parts throughout the several views unless otherwise noted, and wherein.

DETAILED DESCRIPTION

Figure 5:
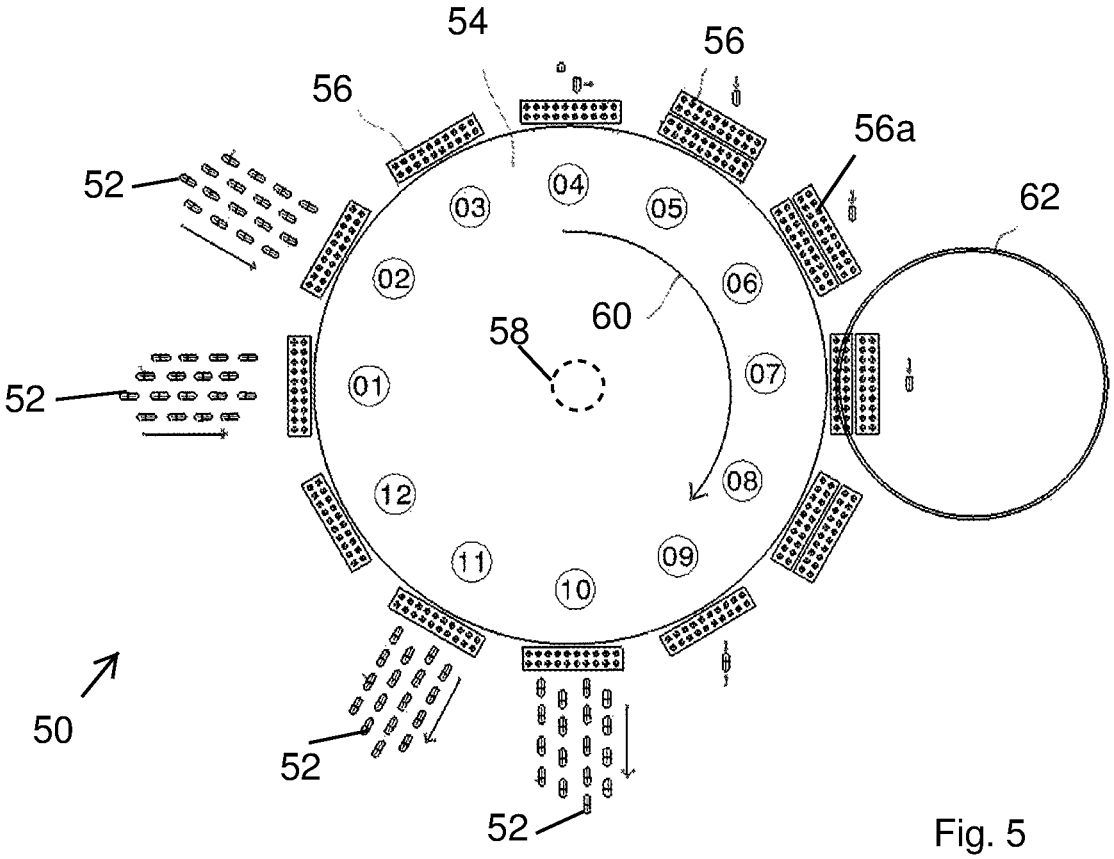
FIG. 5 is schematic top view of a rotary capsule filling machine in which embodiments of the tamping punch station described herein may be implemented.

The tamping punch station shown in the figures forms part of a capsule filling machine for filling for example hard gelatin capsules with for example a powdered filling material. One example of a capsule filling machine 50 is shown schematically in FIG. 5. The capsules 52 generally consist of a capsule top part and a capsule bottom part. The capsule filling machine 50 comprises a conveyor wheel 54, on the perimeter of which a plurality of capsule holders 56 is provided, which have respectively a group of capsule receivers 56*a*, in which respectively one capsule or respectively one capsule bottom part is held. Furthermore, the capsule filling machine 50 comprises a conveyor wheel drive 58, with which the conveyor wheel 54 can be rotated incrementally in the direction of the arrow 60 so that the capsule holders 56 move incrementally along a conveyor track. Moreover, the capsule filling machine 50 comprises a plurality of process stations 01 to 12 arranged along the conveyor track, among other things at least one feeding station 01, 02 for feeding capsules to be filled into the capsule receivers, at least one opening station 03, 04 for opening the capsules 52 to be filled by separating the capsule top parts from the capsule bottom parts, a tamping punch station 05, 06, 07 according to the teachings herein, at least one closing station 08, 09 for closing the filled capsules 52 by connecting the capsule top parts with the capsule bottom parts and at least one ejection station 10, 11 for ejecting the filled capsules. The wheel 62 in FIG. 5 represents a location of one example of the tamping punch station described herein relative to the remainder of the capsule filling machine 50.

Figure 1:
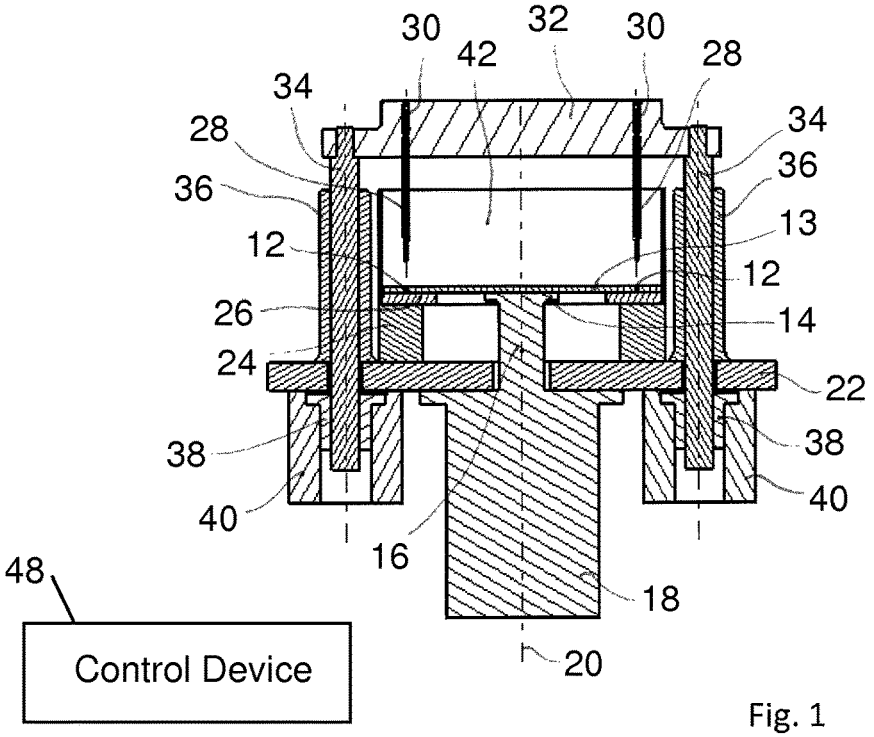
FIG. 1 is a first sectional view of a tamping punch station according to an embodiment of the invention.

A tamping punch station shown in more detail in FIGS. 1-4 has a dosing disk 13, which has several groups of bore holes 12 distributed about its perimeter. A drive shaft 16 is connected with the dosing disk 13 via a flange 14, which is rotatably drivable around the rotational axis 20 by a first drive motor 18, for example a servomotor or torque motor. The dosing disk 13 is also rotated with the drive shaft 16. A base 24, which carries a tamping disk 26, is arranged on a holding plate 22 not rotated with the dosing disk 13. The tamping disk 26 closes the bore holes 12 in the area of the tamping punches 28 downwards and forms a counter bearing for the tamping punches 28. The tamping punches 28 are fastened on a plate- or respectively bridge-shaped punch support 32 via springs 30. In the example shown, drive spindles 34 are fastened on opposite-lying ends of the punch support 32. The drive spindles 34 are received in an axially displaceable manner in guides 36 and engage via an external thread with spindle nuts 38. As shown, the spindle nuts 38 are arranged respectively in an axially fixed manner on the rotor of a hollow shaft motor 40 designed as a hollow shaft and are rotatable with the rotor of the hollow shaft motor 40. As can be seen in FIG. 1, the drive spindles 34 extend through the holding plate 22 into the hollow shafts of the hollow shaft motors 40. Through rotation of the spindle nuts 38, the drive spindles 34 and with them the punch support 32 with the tamping punches 28 and ejection punches explained below are moved in the vertical direction. For example, five groups of tamping punches 28 can be provided. Six groups of bore holes 12 can then be designed in the dosing disk 13, for example. A filling trough 42 is filled with the filling material to be filled into the bore holes.

Figure 2:
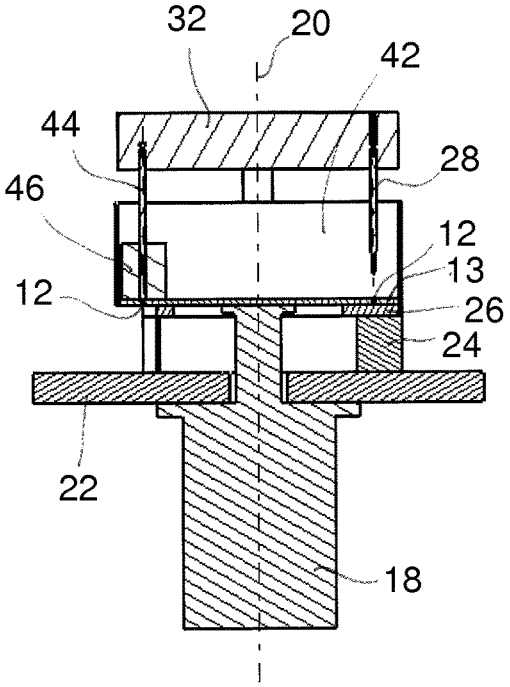
FIG. 2 is a second sectional view of the tamping punch station from FIG. 1.
Figure 3:
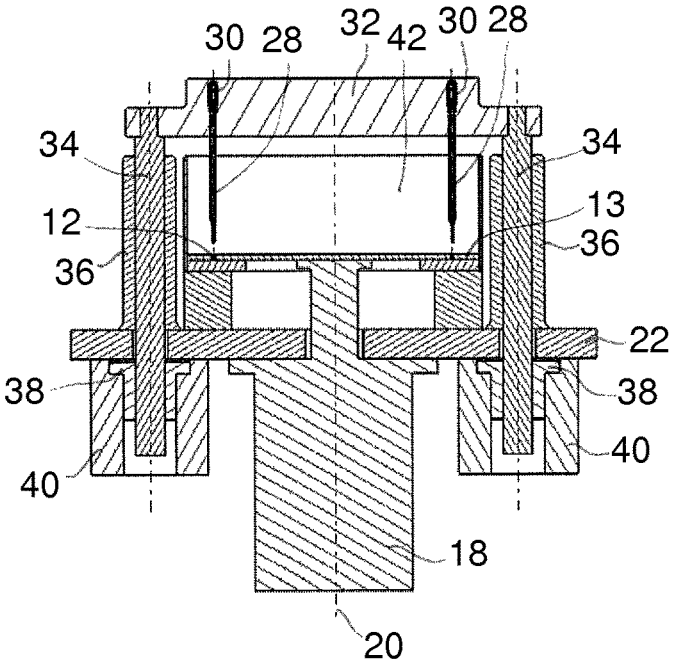
FIG. 3 is a sectional view of the tamping punch station from FIG. 1 in a second operating state.
Figure 4:
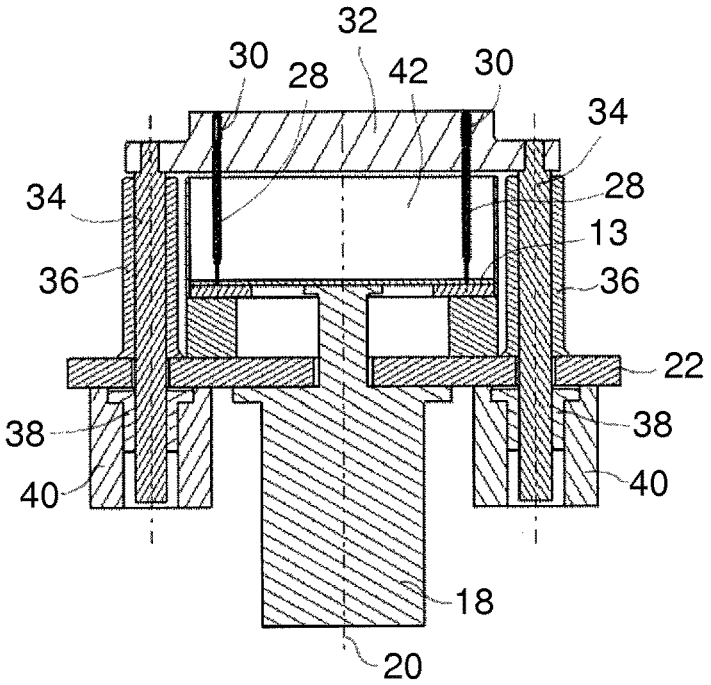
FIG. 4 is a sectional view of the tamping punch station from FIG. 1 in a third operating state.

Referring now to FIG. 2, a group of ejection punches 44 is also held on the punch support 32. As can be seen in FIG. 2, the tamping disk 26 does not cover the bottom side of the bore holes 12 in the area of the ejection punches 44 so that these bore holes 12 are open towards the bottom. A stripping device 46 for stripping filling material from the top side of the dosing disk 13 can be seen in the area of the ejection punches 44.

During operation, the dosing disk 13 is rotated incrementally via the drive motor 18, wherein the groups of bore holes 12 are respectively aligned with a group of tamping punches 28 or respectively the group of ejection punches 44. The spindle nuts 38 are thereby rotated via the hollow shaft motors 40 and thereby the drive spindles 34 and thus the punch support 32 with the tamping punches 28 and the ejection punches 44 are moved in the vertical direction. In this way, the tamping punches 28 in the bore holes 12 successively form pellets from the powdered filling material located in the filling trough 42. The bore holes 12, which are aligned with the ejection punches 44, are open on their bottom side, as mentioned. The ejection punches 44 can thereby eject downwards the pellets created in the bore holes 12 into capsule bottom parts aligned for this, which are located in capsule holders of the capsule filling machine. The movement of the tamping punches 28 downwards and into the bore holes 12 can be seen in FIGS. 3 and 4.

Moreover, a control device 48 (shown schematically only in FIG. 1) controls in a coordinated and suitable manner the drive motor 18 on one hand and the hollow shaft motors 40 on the other hand. The control device 48 may be a computer or other controller executing instructions stored in its memory or external memory to provide signals to motors 18, 40 through any suitable communication means to perform the actions described herein. Due to the separation of the drive means for the dosing disk 13 on one hand and the punch support 32 with the tamping punches 28 and the ejection punches 44 on the other hand, it is possible to variably adjust the switch and rest times. It is also possible to change the stroke length of the punch support 32 and thus of the tamping punches 28 and the ejection punches 44. Suitable sensors can also be provided, with which for example the pressing force in the area of the tamping punches 28 is measured. The measurement results can be sent to one or more inputs of the control device 48 and the control device 48 can execute suitable control circuits at one or more outputs to meet predetermined pressing forces.

Although FIGS. 1-4 show a tamping punch station with several groups of tamping punches 28, a design is also possible in which only one group of tamping punches 28 and one group of ejection punches 44 is provided. It is then possible that the dosing disk 13 is rotated by the drive motor 18 such that the, if applicable, single group of bore holes 12 designed in the dosing disk 13 is aligned with the tamping punches 28. The tamping punches 28 can then be moved into and out of the bore holes 12 multiple times in succession vertically driven by the hollow shaft motors 40 so that a pellet is created in each bore hole 12 successively in several pressing procedures. The dosing disk 13 can then be rotated further so that the group of bore holes 12 is aligned with the group of ejection punches 44 and the ejection punches 44 can eject the pellets produced in the bore holes 12 into capsule bottom parts in the manner explained above. In this case, third drive means (not shown) are provided, with which the ejection punches are moveable independently of the tamping punches. This procedure is offered in particular in the field of galenics (i.e., for galenic formulations). Particularly compact laboratory tamping punch stations can be used.

What is claimed is:

1. A tamping punch station for filling capsules with filling material in a capsule filling machine, the tamping punch station comprising:

a rotatably drivable dosing disk, which comprises a group of bore holes, the dosing disk being movable through a cycle that includes a rest time, during which the dosing disk remains stationary, and a switch time, during which the dosing disk is movable between a plurality of positions;

a filling device for filling the bore holes with the filling material;

a punch support that is vertically moveable;

a group of tamping punches and a group of ejection punches held on the punch support, wherein through vertical movement of the punch support the group of tamping punches for pressing the filling material into the bore holes and the group of ejection punches for ejecting pellets created by the tamping punches in the bore holes are moved into the bore holes;

a first drive device for incremental rotation of the dosing disk along the group of tamping punches and the group of ejection punches; and a second drive device for the vertical movement of the punch support, wherein the second drive device is operable separately from the first drive device such that rotation of the dosing disk is varied independent of vertical movement of the punch support to allow for variation in a ratio between the rest time and the switch time, the second drive device comprises at least two spindle drives acting on the punch support, each spindle drive having a respective spindle nut and a respective vertical drive spindle having a first end extending through a holding plate, a second end fastened to the punch support, and guided in the spindle nut, and the holding plate extending in parallel with the dosing disk and having a first surface facing the dosing disk and a second surface opposite from the first surface, and the second drive device comprises at least two drive motors, each drive motor axially fixedly mounting one of the spindle nuts against the second surface of the holding plate, and driving one of the at least two spindle drives for the vertical movement of the punch support by rotationally driving the one of the spindle nuts to vertically move the first end of the respective vertical drive spindle relative to the holding plate.

2. The tamping punch station according to claim 1, wherein:

the punch support is at least one of a support plate or a support bridge; and a first spindle drive and a second spindle drive of the at least two spindle drives are fastened on opposing sides of the at least one of the support plate or the support bridge.

3. The tamping punch station according to claim 1, wherein each drive motor of the at least two drive motors is an electric motor.

4. The tamping punch station according to claim 1, wherein one of each of the axially fixedly mounted spindle nuts or each vertical drive spindle is arranged in a blind hole of each one of the at least two drive motors at different times.

5. The tamping punch station according to claim 1, wherein:

each drive motor of the at least two drive motors is a hollow shaft motor; and each axially fixedly mounted spindle nut is respectively arranged in a hollow shaft of a respective one of the at least two drive motors.

6. The tamping punch station according to claim 1, wherein the first drive device comprises a servomotor.

7. The tamping punch station according to claim 1, wherein the first drive device comprises a torque motor.

8. The tamping punch station according to claim 1, wherein the dosing disk comprises at least two groups of bore holes.

9. The tamping punch station according to claim 1, wherein:

the dosing disk comprises n groups of bore holes, wherein n>2; and the group of tamping punches is n−1 groups of tamping punches held on the punch support.

10. The tamping punch station according to claim 1, wherein:

each of the at least two drive motors is a hollow shaft motor with a first end having a hollow shaft, the first end in contact with the second surface of the holding plate;

the one of the spindle nuts is arranged within the first end of the hollow shaft motor; and the first end of the hollow shaft motor is in contact with the second surface of the holding plate to axially fixedly mount the one of the spindle nuts against the second surface of the holding plate.

11. The tamping punch station according to claim 10, wherein:

each of the at least two drive motors is a hollow shaft motor with a first end having a hollow shaft, the first end in contact with the second surface of the holding plate; and each spindle nut has a radially-extending flange at a first end that is engaged with a corresponding inner surface of a respective hollow motor and with the second surface of the holding plate to axially fixedly mount the spindle nut against the second surface of the holding plate.

12. The tamping punch station according to claim 1, further comprising:

a control device receiving measured pressing forces occurring while pressing the filling material into the bore holes, and regulating the pressing forces to meet a defined mass and density for the pellets.

13. The tamping punch station according to claim 1, further comprising:

pressing force sensors with which pressing forces occurring during production of the pellets are measured.

14. A capsule filling machine for filling capsules put together from a capsule top part and a capsule bottom part, the capsule filling machine comprising:

a conveyor wheel, on a perimeter of which a plurality of capsule holders is provided, each of which has a group of capsule receivers for respectively receiving one capsule;

a conveyor wheel drive, with which the conveyor wheel can be rotated incrementally so that the capsule holders move incrementally along a conveyor track; and a plurality of process stations arranged along the conveyor track, wherein the process stations comprise at least one feeding station for feeding capsules to be filled into the capsule receivers, at least one opening station for opening the capsules to be filled by separating the capsule top parts from the capsule bottom parts, at least one tamping punch station according to claim 1, at least one closing station for closing the filled capsules by connecting the capsule top parts with the capsule bottom parts, and at least one ejection station for ejecting the filled capsules.

15. A method for filling capsules with filling material in a tamping punch station of a capsule filling machine, the tamping punch station comprising a rotatably drivable dosing disk, which comprises a group of bore holes, the dosing disk being movable through a cycle that includes a rest time, during which the dosing disk remains stationary, and a switch time, during which the dosing disk is movable between a plurality of positions, a filling device for filling the bore holes with the filling material, a punch support that is vertically moveable, a group of tamping punches and a group of ejection punches held on the punch support, wherein through vertical movement of the punch support the group of tamping punches for pressing the filling material into the bore holes and the group of ejection punches for ejecting pellets created by the tamping punches in the bore holes are moved into the bore holes, a first drive device for incremental rotation of the dosing disk along the group of tamping punches and the group of ejection punches, and a second drive device for vertical movement of the punch support, the method comprising:

rotating the dosing disk into a rotational position in which the group of bore holes is aligned with the group of tamping punches using the first drive device;

moving, using the second drive device, the punch support vertically so as to move the group of tamping punches for pressing the filling material filled in the bore holes into pellets into the bore holes, wherein the group of tamping punches is held for a pressure hold time in the bore holes and then retracted from the bore holes;

rotating the dosing disk into a rotational position in which the bore holes are aligned with the group of ejection punches using the first drive device; and moving the punch support vertically so as to move the group of ejection punches into the bore holes for ejection of the pellets created by the group of tamping punches in the bore holes, wherein:

the pressure hold time of the group of tamping punches is varied between different filling processes through variable control of at least one of the first drive device or the second drive device, the second drive device is operable separately from the first drive device such that rotating the dosing disk is varied independent of moving the punch support to allow for variation in a ratio between the rest time and the switch time, the second drive device comprises at least two spindle drives acting on the punch support, each spindle drive having a respective spindle nut and a respective vertical drive spindle having a first end extending through a holding plate, a second end fastened to the punch support, and guided in the spindle nut, and the holding plate extending in parallel with the dosing disk and having a first surface facing the dosing disk and a second surface opposite from the first surface, and the second drive device comprises at least two drive motors, each drive motor axially fixedly mounting one of the spindle nuts against the second surface of the holding plate, and driving one of the spindle drives for the vertical movement of the punch support by rotationally driving the one of the spindle nuts to vertically move the first end of the respective vertical drive spindle relative to the holding plate.

16. The method according to claim 15, further comprising:

rotating the dosing disk in at least one of a first rotational direction or a second rotational direction after moving the group of tamping punches for pressing the filling material and before rotating the dosing disk into the rotational position in which the bore holes are aligned with the group of ejection punches by means of the first drive device until the dosing disk again assumes the rotational position in which the group of bore holes is aligned with the group of tamping punches.

17. The method according to claim 15, wherein movement of the group of ejection punches into and out of the bore holes takes place by the second drive device or that the movement of the group of ejection punches into and out of the bore holes takes place by a third drive device such that the group of ejection punches is moveable independently of the group of tamping punches.

18. The method according to claim 15, further comprising:

receiving, by a control device, measured pressing forces occurring while pressing the filling material into the bore holes; and regulating, but the control device, the pressing forces to meet a defined mass and density for the pellets.

* * * * *